US006409058B1

(12) United States Patent
Lam et al.

(10) Patent No.: US 6,409,058 B1
(45) Date of Patent: Jun. 25, 2002

(54) ADJUSTABLE GARMENT HANGER

(76) Inventors: Peter Ar-Fu Lam, 20104 Wayne Ave., Torrance, CA (US) 90503; Andrew Y. K. Siu, 1532 Stanford Ave., Redondo Beach, CA (US) 90278

( * ) Notice: Subject to any disclaimer, the term of this patent is extended or adjusted under 35 U.S.C. 154(b) by 0 days.

(21) Appl. No.: 09/699,071

(22) Filed: Oct. 26, 2000

(51) Int. Cl.[7] ..... A47G 25/44

(52) U.S. Cl. ..... 223/94; 223/85; 223/89; 40/322

(58) Field of Search ..... 223/94, 89, 85

(56) References Cited

U.S. PATENT DOCUMENTS 5,456,391 A * 10/1995 Chang ..... 223/94
5,511,701 A * 4/1996 Lam ..... 223/85
5,664,710 A * 9/1997 Lam ..... 223/94
5,975,385 A * 11/1999 See ..... 223/94

* cited by examiner

*Primary Examiner*—Rodney M. Lindsey
*Assistant Examiner*—James G Smith

(57) ABSTRACT

An adjustable garment hanger (100) is disclosed having movable arms (107) which move laterally from a medial portion (102). The movable arms move as a result of engagement between a pair of linkage tongues (110, 125) and a medially positioned adjustment mechanism (103, 133). The linkage tongue 110 guided by a channel (113), extends beyond the remote terminal (105) of the supporting arm and connected to the remote region (108) of the movable arm (107).

30 Claims, 2 Drawing Sheets

ADJUSTABLE GARMENT HANGER

FIELD OF THE INVENTION

The present invention relates to garment hangers.

BACKGROUND OF INVENTION

Garments are optimally displayed and maintained on hangers sized appropriately to the garment. A garment manufacturer or retailer can achieve this either by using differently sized fixed width hangers or by using adjustable width hangers. Similarly, an end user could adopt a particularly sized fixed width hanger or selectively adjust an adjustable width hanger to his garment size.

The prior art is replete with various configurations of garment hangers which incorporate structure for selectively adjusting the hanger's width to accommodate different size garments. Applicant's issued U.S. Pat. Nos. 5,102,019; 5,511,701 and 5,664,710 disclose some such structures as do certain ones of the references U.S. Pat. Nos. 2,477,873, 3,024,954, 5,044,535, European patents DE-C-286 192, WO-A-94 02056, DE-U-88 04 572 and DE-A-40 07 320 cited therein.

SUMMARY OF THE INVENTION

The present invention is directed to garment hangers incorporating improved structures for adjusting the hanger's width to support garments of different sizes.

According to one aspect of the present invention there is provided an adjustable garment hanger having first and second elongated support arms extending from a medial portion, a transfer mechanism located at the medial portion; and first and second movable arms mounted respectively for translation along the first and second support arms. The first and second support arms are supported relative to one another at an obtuse angle therebetween; and in that each of the movable arms couples to the transfer mechanism by a linkage tongue is for reciprocal translation of the movable arms along their respective support arms. When force is applied on the first movable arm in the direction along the axis of the respective first support arm, the force is translated to the second extension arm for reciprocal motion of the second extension arm along the second support arm. The transfer mechanism incorporated in this embodiment is at least one wheel and in that each of the linkage tongues is coupled to the wheel for reciprocal translation of the movable arms along their respective support arms. Each of the linkage tongues is preferred to comprise a flexible section, located at the region proximate to the medial portion of the hanger.

In another alternative embodiment, an adjustment knob is integrally molded or coupled to the wheel to facilitate manual turning thereof for translation of the movable arms. Conveniently, an electric motor is provided for driving the wheel.

In yet a further embodiment a transfer mechanism preferably comprising at least a first wheel mounted approximal to the medial portion for rotation; each of the linkage tongues having an inner end and an outer end. The inner ends of each linkage tongue is coupled to the transfer mechanism for reciprocal translation of the movable arms along their support arms. Advantageously, in any of the embodiments the wheel(s) includes a plurality of peripherally defined teeth and each inner end of the linkage tongues defines a plurality of teeth. Although the linkage tongue is preferably to be of a rigid structure for this embodiment, it can also comprise a flexible region to interact with the adjustment or transfer mechanism.

According to another aspect of the present invention there is provided a method of forming an adjustable garment hanger, comprising the steps of arranging first and second elongate support arms to define an obtuse angle therebetween; providing an adjustment or transfer mechanism at the medial portion of the hanger; mounting open ended first and second linkage tongues on the first and second arms respectively for translation therealong; and for reciprocal translation of the linkage tongues along their respective support arms; mounting first and second movable arms to travel along the respective supporting arms; and connect each linkage tongues with the respective movable arms.

In yet another embodiment, the medial portion and the two supporting arms are divided into two halves; a front half and a rear half. The medial portion and the supporting arms of each half are formed as an integral part by injection molding or die casting. In this embodiment, after the open ended linkage tongues are installed in one of the two halves, the other half is covered onto the assembly before the movable arms are assembled.

In a further preferred embodiment channels are provided for guiding each of the linkage tongues along a path that feed the linkage tongue to the adjustment or transfer mechanism located at the medial portion of the garment hanger. Conveniently, each of the channel or paths includes a first segment substantially aligned with one of the support arms and a second segment substantially aligned with the other of the support arms. The channels, or guides, preferable be able to guide the flexible linkage tongue along the respective supporting arm, have guiding walls surrounding the linkage tongue so as to maintain the flexible region of the linkage tongue to stay in a proper shape under control. For that reason, the medial portion and supporting arms are preferable to be structured of two halves made with injection molding process to provide the fully enclosed guiding walls required.

Another characteristic of the subject embodiment is that the full length of each supporting arm comprises of two guiding channels, one on top of each other. One of the guiding channels is configured to receive the linkage tongue connecting the movable arms sliding along the same supporting arm. An opening is required at the end of the supporting arm to allow the linkage tongue to extend external to the supporting arm for connecting the movable arm. The other guiding channel is to receive the proximal region of the linkage tongue located at the other supporting arm of the hanger. The full length of guiding wall to receive the return linkage tongue from the other supporting arm maximizes the travel distance of the movable arms.

In order to prevent the movable arms and the linkage tongues to be removed from the garment hanger when the movable arms are stretched to the outermost position, stoppers interacting between the linkage tongues and the guiding walls or a stopping structure at the medial portion are provided. Alternatively, interacting stopper can be provided in between the support arms and the moving arms as disclosed in applicant's issued U.S. Pat. No. 5,727,718. Many different stopper designs known to the art can be implemented to restrict the movement of the linkage tongues or the movable arms when they are extended to a predefined extended position.

It is a design goal to have an integrally molded movable arm and linkage tongue to reduce production cost. There is an assembly procedure conflict to assemble an integral linkage tongue and movable arms onto a supporting arm comprising of two halves to provide guiding channels surrounding the linkage tongue. The linkage arm needs to be assembled into one half of the supporting arm, properly aligned with the transfer mechanism, then the opening is closed by the other half of the supporting arm. Typical mounting structure of a movable arm requires the supporting arm to be fully assembled before the movable arm is slid into the supporting arm from the end. It is very difficult in product to assemble a linkage arm integral to a movable arm into a two halves supporting arm assembly. is To resolve this assembly procedure conflict, the linkage tongue is produced as an open ended part separated from the movable arm. The open ended linkage tongue is then reconnected to the movable arm after the linkage tongue is fully assembled into the two halved of the supporting arms; and after the movable arm is mounted onto the supporting arm.

Another characteristic of the embodiment is that the linkage tongue extends from the end, or remote terminal of the supporting arm through the opening of the guiding channel, and is exposed from the supporting arm all the time. The remote open end of the linkage tongue is then connected to the remote region of the moving arm in a later process of assembly. An explanatory connection design is to provide a receiver at the remote end of the linkage tongue. A mating pin is provided at the remote region of the movable arm to force fit with the receiver of the linkage tongue. There are various designs well known to a person skilled in the art suitable to connect two separated parts together. All these variations are considered to be within the scope of the subject invention. Since one end of the linkage tongue is connected to the remote region of the movable arm, and the other end is connected to the adjustment mechanism located at the medial portion of the garment hanger, it is yet another characteristic of this embodiment that the total length of the linkage tongue is longer that the maximum span of the respective support arm and movable arm combined.

DESCRIPTION OF THE PREFERRED EMBODIMENTS

Figure 1:
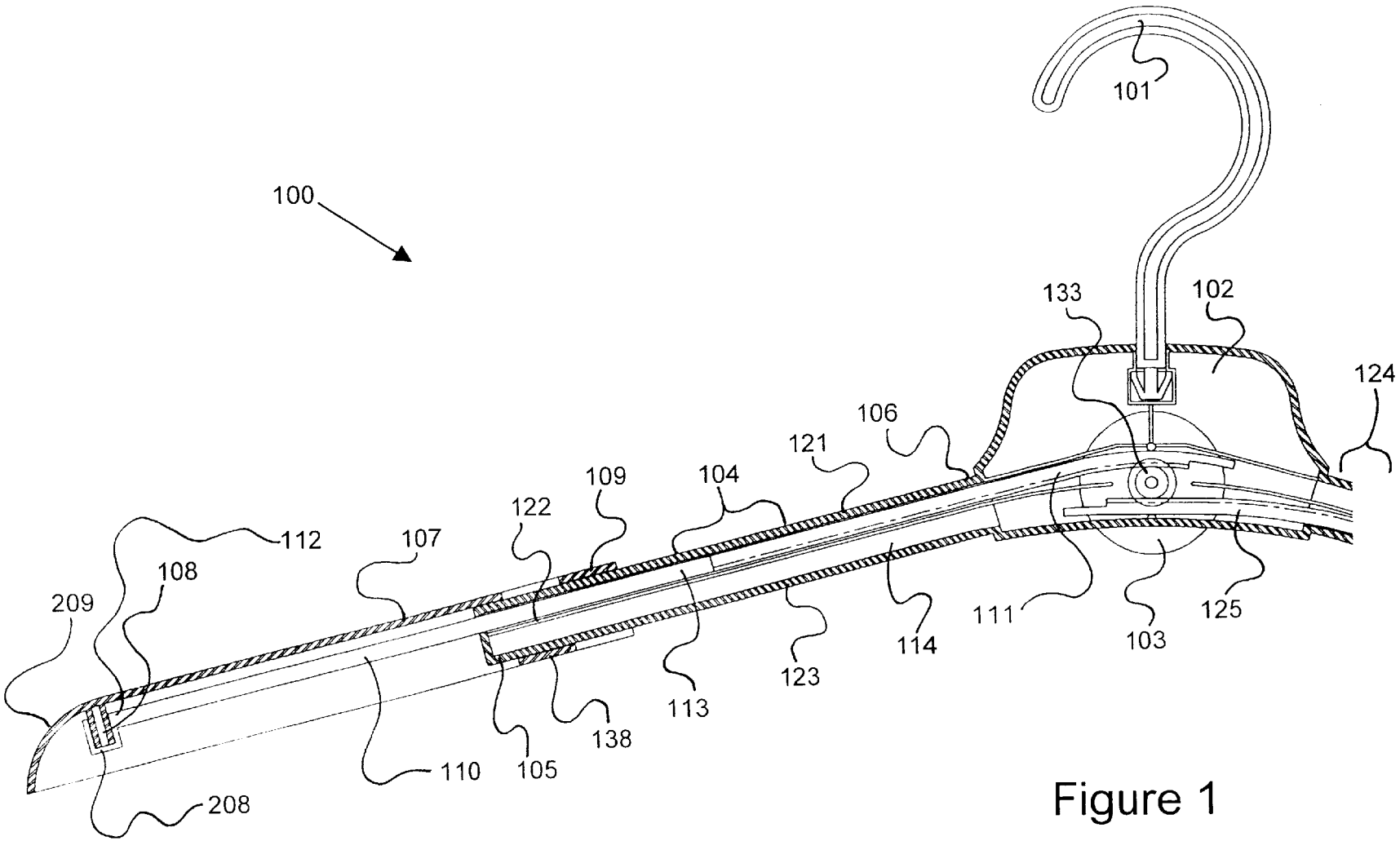
FIG. 1 is a see through view of an adjustable garment hanger showing a preferred embodiment in accordance with the present invention.

FIG. 1 is an elevation view illustrating a preferred adjustable hanger embodiment 100 in accordance with the present invention. The hanger 100 includes a medial portion 102 connected with a pair of elongate supporting members in the form of arms 104, 124 and a suspension member 101 in the shape of a hook. The supporting arm 104 is arranged to define an obtuse angle between the other supporting arm 124 and respectively carries slidable movable arms 107. The movable arm 107 is connected with a linkage tongue 110 extending from the supporting arm 104. The proximal region 111 of the linkage tongue 110 is guided to engage an adjustment or transfer mechanism 133. In a preferred embodiment this adjustment mechanism is represented by a gear or wheel rotatably mounted at the medial portion 102 of the frame garment hanger. The transfer mechanism 133 is connected to an adjustable knob 103 for adjusting the width of the hanger. The flexible proximal region 111 of the linkage tongue 110 follows a respective guide path that is tangent to the transfer mechanism. This guiding channel or path includes path segment 113 substantially parallel to the supporting arm 104.

Thus, each linkage tongues 110, 125 can be reciprocally translated along its respective supporting arm according to the function of the transfer mechanism 113. Movement of the linkage tongues 110, 125, and the respective movable arms they connected can be accomplished by grasping each movable arm in one hand and urging them inward or outward. Alternatively, the garment hanger can be grasped in one hand and either one of the movable arms urged inward or outward with the other hand. Engagement of the flexible region 111 with the transfer mechanism insures that any change in the spacing of one linkage tongue or movable arm from the frame medial portion 102 is accompanied by an equal change in the spacing of the other linkage tongue and movable arm, i.e., the linkage tongues 110, 125 are reciprocally and oppositely translated on their respective supporting arms. In another preferred embodiment, an adjustment knob 103 coupled to the transfer mechanism allows the user to adjust the width of the hanger while a garment is supported on the hanger.

A hanger 100 is, therefore, provided which can be quickly and easily adjusted to a lateral spacing between movable arms that most effectively supports a chosen garment. The movable arms are simply urged inward or outward by hand or an adjustment knob as necessary to best fit and support the garment and they remain in the desired spacing until readjusted for another garment. The hanger can be fabricated with an obtuse angle, between the supporting arms 104, 124, that best accommodates and supports a chosen garment type, e.g., coats.

Directing attention now to a more detailed disclosure of the preferred embodiment relative to FIG. 1. It is seen that the hanger 100 defines the supporting arms 104, 124 and a medial frame portion 102. The arms 104, 124 are arranged to define the obtuse angle therebetween and each is respectively joined at a proximal end 106 to the medial portion 102. The hanger 100 is in the form of a hollow housing which defines an interior chamber extending laterally between the respective remote terminal 105 of the supporting arm 104. The hanger 100 may be formed, for example, of two halves: a front half and a rear half, which are molded of a polymer and bonded or locked together along a laterally arranged partition line. A pair of laterally directed slots or channels 113, 114 are defined respectively along the supporting arm 104 to communicate with the medial portion 102.

The supporting arm 104 comprises of two guiding channels, an upper channel 113 and a lower channel 114. The upper channel 113 is formed by the upper wall 121, the middle wall 122 and the side walls of the front and rear halves of the supporting arm. The lower channel 114 is formed by the middle wall 122, the lower wall 123 and the side walls of the front and rears halves of the supporting arm. The upper channel 113 aligns the linkage tongue 110 and guide it to engage with the transfer mechanism 133. The remote terminal 105 of the supporting arm 104 comprises an opening located at the upper channel position enabling the linkage tongue 110 to extend beyond the extension of the supporting arm 104. The lower channel 114 is configured to receive the proximal region of the other linkage tongue 125 when the movable arms of the hanger are at the innermost position. It should be noted that in this preferred embodiment, the upper channel 113 and the lower channel 114 occupy the full length of the supporting arm 104.

The movable arm 107 is mounted to slide along the supporting arm 104. The remote end 112 of the linkage tongue 110 comprises of a receiver 208 designed to connect the remote region 108 of the movable arm 107. It should be noted that the full extension of the linkage tongue 110 is longer than the maximum extension of the movable arm 107 and the supporting arm 104 combined. The lower surface of the tongue 110 defines a plurality of spaced teeth so that the motion of the tongue 110 is translated to the other side of the garment hanger.

Figure 2:
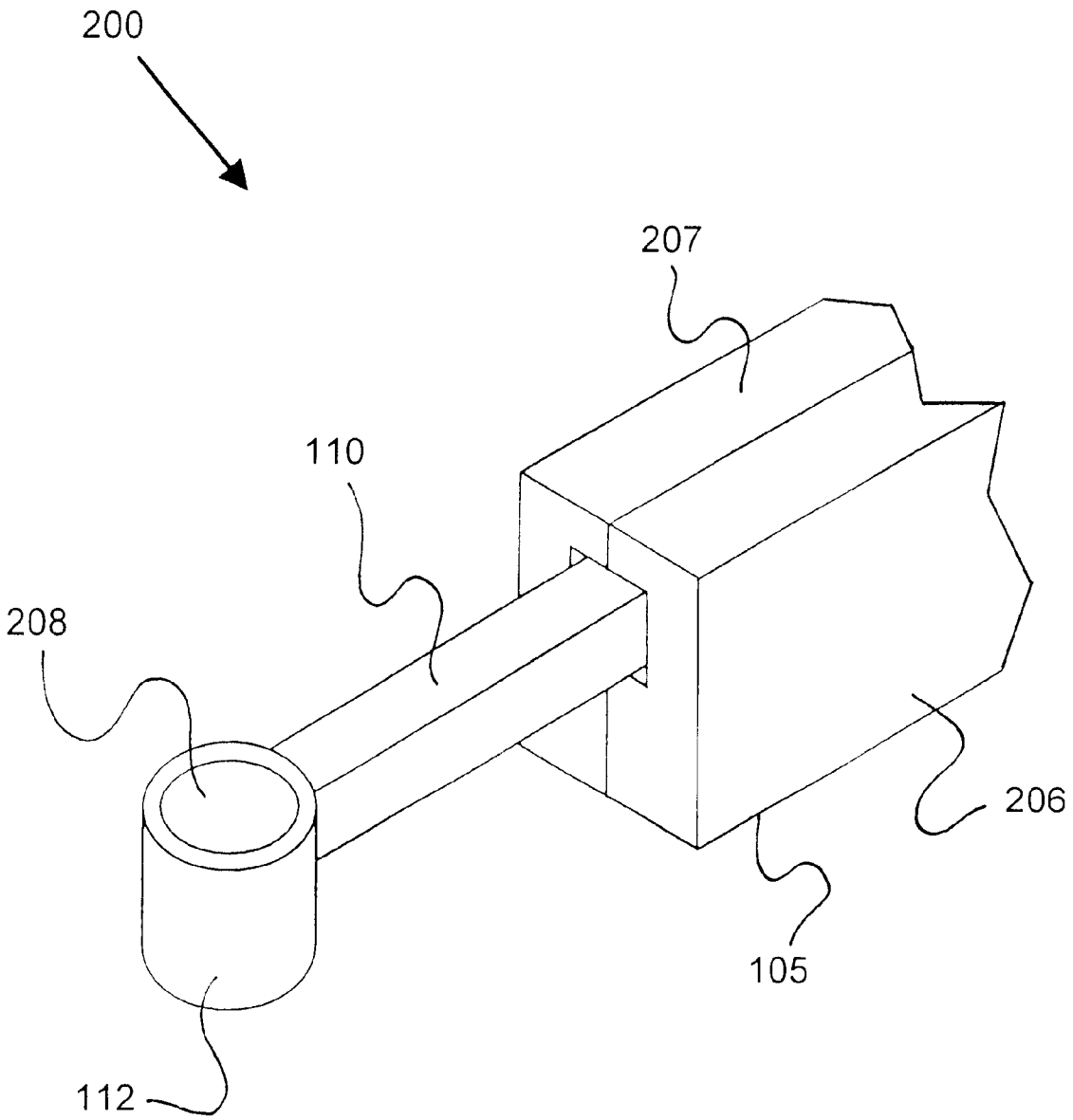
FIG. 2 is an enlarged view to illustrate the two halves of the supporting arms, and the elongated linkage tongues extending from a supporting arm.

Attention is now directed to FIG. 2 where a view of the remote terminal 105 of the supporting arm 104 is enlarged. The supporting arm 104 comprises of a first front half 206 and a second rear half 207. An opening located at the remote terminal 105 of the supporting arm 104 enable the linkage tongue 110 to be extended beyond the upper guiding channel internal to the supporting arm 104.

During the assembly process of the preferred embodiment, one of the two halves of the hanger is arranged to receive an adjustment mechanism 103, 133, and the linkage tongues 110 and 125. The linkage tongue 110 is aligned to travel along the upper channel 113. The proximal region 111 of the linkage tongue is a flexible segment engaged with the adjustment mechanism 133. The remote end 112 of the linkage arm is arranged to extend from the remote terminal 105 of the supporting arm through an opening located at the end of the supporting arm 104. The next step is to assemble the other half of the housing; such that the front housing is mounted with the rear housing. The suspension member 101, the adjustment mechanism 103, 133; and the linkage tongues 110 and 125 are secured when the two halves of the medial portion and the supporting arms are mounted together. A stopper is required to interact between the linkage arm and part of the supporting arms or medial portion to limit the travel of the linkage tongues so that they cannot be removed when the tongues are extended to their outermost position. The next step is to slide the movable arm 107 into the supporting arm 104 until the supporting wall 138 is engaged with the supporting arm 104. The last step is to connect the pin 209 located at the remote region 108 of the movable arm 104 with the receiver 208 located at the remote end 112 of the linkage tongue 110.

In use of the hanger 100, the user may grasp each movable arm and urge them inward or outward to effect lateral movement along the supporting arms. Alternatively, a user may grasp the frame of the hanger 100 with one hand while urging one of the extension members towards or away from the medial portion 102. Another method to adjust the width of the hanger is to rotate the knob 103 of the adjustment mechanism.

The obtuse angle between the arms 104, 124 is necessary if the hanger 100 is to effectively support garments, e.g., coats, shirts, dresses, whose shoulder portions (or other portions) are typically formed with an obtuse angle therebetween The obtuse angle between the supporting arms permits the hanger 100 to support such garments in their natural form to enhance their appearance and extend their lifetime. For example, a hanger intended for support of coats might be configured with an obtuse angle between 110 and 150 degrees. It should be appreciated that the structural features recited above (in particular, the flexible linkage tongues and the path segments along which they are guided) enable the arrangement of the supporting arms 104, 124 with the desirable obtuse angle therebetween.

From the foregoing it should now be recognized that embodiments of an adjustable garment hanger have been disclosed herein especially suited for lateral adjustment to enhance the fit between a garment and its supporting hanger.

Apparatus in accordance with the present invention may be quickly adjusted to conform with different garment sizes. Different movable arms can be shaped to conform to different garments, e.g., coats, dresses. The hanger can then be modified by slidably replacing its extension members with ones directed to a different garment. It should be understood that although embodiments have been disclosed having pairs of movable arms moving in opposite directions from a medial frame portion, other embodiments may include different configurations based on the similar concept of structure.

What is claimed is:

1. A garment hanger having a medial portion;

first and second supporting arms extending in opposite direction from said medial portion;

first and second movable arms configured to travel along said first and second supporting arms for defining an adjustable garment supporting width; each of said movable arms having a remote region remote from said medial portion and a proximal terminal closer to said medial portion; and first and second linkage tongues, each having a remote end connected to a remote region of said movable arms and a proximal region coupled to the medial portion of said hanger for adjusting the position of said movable arms.

2. The garment hanger of claim 1 wherein any of said supporting arms comprises of a first half body and a second half body mounted together.

3. The garment hanger of claim 1 wherein the remote region of said movable arms locate beyond the extension of said supporting arms.

4. The garment hanger of claim 1 wherein each of said linkage tongues is coupled to an adjustment mechanism located within said medial portion for the reciprocal adjustment of said movable arms.

5. The garment hanger of claim 1 wherein each of said supporting arms has a remote terminal remote from said medial portion and the remote ends of said linkage tongues extend from the remote terminals of said supporting arms.

6. The garment hanger of claim 1 wherein each of said supporting arms further comprising a channel to accommodate at least a portion of said linkage tongue.

7. The garment hanger of claim 6 wherein said channel occupies the full extension of the respective supporting arm.

8. The garment hanger of claim 1 wherein a least a portion of said linkage tongues is elastic.

9. A garment hanger having a medial portion;

first and second supporting arms extending in opposite directions from said medial portion; each supporting arm having a remote terminal remote from said medial portion and a proximal end closer to said medial portion;

first and second movable arms configured to travel along said first and second supporting arms for defining an adjustable garment supporting width;

each of said movable arms having a proximal terminal oriented from the direction of said medial portion and a remote region remote from said medial portion; and first and second linkage tongues located substantially along said first and second supporting arms, each linkage tongue having a remote open end extending from the remote terminal of said corresponding supporting arm; wherein the remote open end of said linkage tongue is connected to the corresponding movable arm for adjusting the width of said garment hanger.

10. The garment hanger of claim 9 wherein the remote open end of said linkage tongue is connected to the remote region of the corresponding movable arm.

11. The garment hanger of claim 9 wherein each of said linkage tongues comprise of a proximal region coupled to a transfer mechanism located at said medial portion for adjusting the width of said garment hanger.

12. The garment hanger of claim 9 wherein the medial portion and the two supporting arms comprise of two integral halves of a body.

13. A garment hanger having a medial portion;

first and second supporting arms extending in opposite direction from said medial portion; each supporting arm having a remote terminal remote from said medial portion;

first and second movable arms mounted to travel along said first and second supporting arms for defining an adjustable garment supporting width; each of said movable arms having a remote region remote from said medial portion and a proximal terminal closer to said medial portion; and first and second linkage tongues located substantially along said first and second supporting arms, each linkage arm having a remote end connected to said movable arms and a proximal region coupled to the medial portion of said hanger for adjusting the position of said movable arms; wherein one of said linkage tongues is longer than the maximum extension length of the corresponding supporting arm and movable arms mounted together.

14. The garment hanger of claim 13 wherein the remote end of said linkage tongue is connected to the remote region of the corresponding movable arm.

15. The garment hanger of claim 13 wherein each of said linkage tongue extends from the remote terminal of the corresponding supporting arm.

16. The garment hanger of claim 13 wherein each of said supporting arms further comprising a channel to accommodate at least a portion of said linkage tongue.

17. An adjustable garment hanger comprising:

a medial portion;

first and second supporting arms extending in opposite direction from said medial portion;

first and second movable arms configured to travel along said first and second supporting arms for defining an adjustable garment supporting width; each of said movable arms having a remote region remote from said medial portion and a proximal terminal closer to said medial portion;

first and second open ended linkage tongues, each having a remote end connected to one of said movable arms and a proximal region coupled to the medial portion of said hanger for adjusting the position of said movable arms;

wherein each of said supporting arms comprises of at least two guiding channels, one for each of the two linkage tongues.

18. The adjustable garment hanger of claim 17 wherein an opening is provided at the end of each supporting arm for a linkage tongue to extend beyond said supporting arm.

19. the adjustable garment hanger of claim 17 wherein the full length of each supporting arm is occupied by said guiding channels.

20. A method to assemble an adjustable garment hanger comprising the steps of:

(1) providing a medial portion of a hanger and two supporting arms extending at opposite directions from said medial portion;

(2) providing two linkage tongues, each has a remote end remote from said medial portion;

(3) arranging one or more guiding channels along each of said supporting arms and align one of said linkage tongues into each of said channels;

(4) mounting a first and a second movable arms to the respective supporting arms of said hanger; and (5) following step (4), connecting the remote ends of said linkage tongues to said movable arms.

21. The method of claim 20 further comprising the steps of:

(6) arranging a first half and a second half of each supporting arms, wherein the guiding channel of step (3) locates in between said first and second half of said supporting arms; and (7) arranging the linkage tongues of step (2) to position in between said first half and second half of step (6).

22. The method of claim 21 wherein one of the two halves of said supporting arms and at least a part of said medial portion is an integral part.

23. The method of claim 20 further comprising a step to connect said linkage tongues to an adjustment mechanism located at said medial portion for the adjustment of said movable arms.

24. The method of claim 20 further comprising a step to arrange the remote ends of said linkage tongues to extend from the remote terminals of said supporting arms.

25. The method of claim 20 wherein each movable arm comprises a remote region remote from said medial portion, and the terminal ends of said linkage tongues in step (5) are connected to the remote regions of said movable arms.

26. A garment hanger having a medial portion;

first and second supporting arms extending in opposite direction from said medial portion;

first and second movable arms configured to travel along said first and second supporting arms for defining an adjustable garment supporting width; each of said movable arms having a remote region remote from said medial portion and a proximal region closer to said medial portion; and first linkage tongues having a remote end connected said first movable arm for adjusting the position of said first movable arm; wherein the proximal region of said first linkage tongue extends to a side by side position parallel with said second movable arm when said second movable arm is in it's innermost position.

27. The garment hanger of claim 26 wherein said first linkage tongue is engaged to a transfer mechanism for reciprocal translation of said movable arms.

28. The garment hanger of claim 26 wherein the movement of said first linkage arm is guided by said first supporting arm.

29. The garment hanger of claim 26 wherein said first linkage tongue is enclosed by said first supporting arm on at least three sides.

30. The garment hanger of claim 29 wherein in both first linkage tongue and first supporting arm are enclosed by said first movable arm when said first movable arm is in the innermost position.

* * * * *